US007757791B2

(12) United States Patent
Belnap et al.

(10) Patent No.: US 7,757,791 B2
(45) **Date of Patent: *Jul. 20, 2010**

(54) CUTTING ELEMENTS FORMED FROM ULTRA HARD MATERIALS HAVING AN ENHANCED CONSTRUCTION

(75) Inventors: John Daniel Belnap, Pleasant Grove, UT (US); Stewart N. Middlemiss, Salt Lake City, UT (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/059,940

(22) Filed: Mar. 31, 2008

(65) Prior Publication Data

US 2008/0179109 A1 Jul. 31, 2008

Related U.S. Application Data

(63) Continuation of application No. 11/043,901, filed on Jan. 25, 2005, now Pat. No. 7,350,601.

(51) Int. Cl.
*E21B 10/46* (2006.01)

(52) U.S. Cl. ..... 175/434; 175/374; 428/408

(58) Field of Classification Search ..... 175/374, 175/425, 426, 434; 428/408; 2/374, 425, 2/426, 434

See application file for complete search history.

(56) References Cited

U.S. PATENT DOCUMENTS

| | | | |
|---|---|---|---|
| 3,136,615 | A | 6/1964 | Bovenkerk et al. |
| 3,141,746 | A | 7/1964 | Lai |
| 3,233,988 | A | 2/1966 | Wentorf, Jr. et al. |
| 3,745,623 | A | 7/1973 | Wentorf, Jr. et al. |
| 4,108,614 | A | 8/1978 | Mitchell |

(Continued)

FOREIGN PATENT DOCUMENTS

| | | |
|---|---|---|
| EP | 0196777 | 10/1986 |

(Continued)

OTHER PUBLICATIONS

UK Search Report for corresponding British Patent Application No. GB 0601440.1 dated Mar. 20, 2006, 1 page.

(Continued)

*Primary Examiner*—Giovanna C Wright
(74) *Attorney, Agent, or Firm*—Connolly Bove Lodge & Hutz LLP

(57) ABSTRACT

Cutting elements of this invention include an ultra hard body joined with a metallic substrate. The body includes an uppermost layer comprising a plurality of bonded ultra hard crystals and interstitial regions, and that form a body working surface. The uppermost layer includes a thermally stable outer region that is substantially free of a catalyst material. The body includes an intermediate layer joined to the uppermost layer, comprising a plurality of bonded ultra hard crystals, and having a wear resistance less than that of the uppermost layer remaining region. The intermediate material can include a catalyst and other materials. The ultra hard crystals can be diamond, and the volume fraction of crystals in the uppermost layer can be greater than that in the intermediate layer. The body may additionally include a lowermost PCD layer interposed between and attached to the intermediate layer and the substrate.

27 Claims, 3 Drawing Sheets

U.S. PATENT DOCUMENTS 4,151,686 A 5/1979 Lee et al.
4,224,380 A 9/1980 Bovenkerk et al.
4,255,165 A 3/1981 Dennis et al.
4,268,276 A 5/1981 Bovenkerk
4,288,248 A 9/1981 Bovenkerk et al.
4,303,442 A 12/1981 Hara et al.
4,311,490 A 1/1982 Bovenkerk et al.
4,373,593 A 2/1983 Phaal et al.
4,387,287 A 6/1983 Marazzi
4,412,980 A 11/1983 Tsuji et al.
4,481,016 A 11/1984 Campbell et al.
4,486,286 A 12/1984 Lewin et al.
4,504,519 A 3/1985 Zelez
4,522,633 A 6/1985 Dyer
4,525,179 A 6/1985 Gigl
4,534,773 A 8/1985 Phaal et al.
4,556,403 A 12/1985 Almond et al.
4,560,014 A 12/1985 Geczy
4,570,726 A 2/1986 Hall
4,572,722 A 2/1986 Dyer
4,604,106 A * 8/1986 Hall ..... 51/293
4,605,343 A 8/1986 Hibbs, Jr. et al.
4,606,738 A 8/1986 Hayden
4,621,031 A 11/1986 Scruggs
4,636,253 A 1/1987 Nakai et al.
4,645,977 A 2/1987 Kurokawa et al.
4,662,348 A 5/1987 Hall et al.
4,664,705 A 5/1987 Horton et al.
4,670,025 A 6/1987 Pipkin
4,694,918 A 9/1987 Hall
4,707,384 A 11/1987 Schachner et al.
4,729,440 A * 3/1988 Hall ..... 175/107
4,766,040 A 8/1988 Hillert et al.
4,776,861 A 10/1988 Frushour
4,784,023 A 11/1988 Dennis
4,792,001 A 12/1988 Zijsling
4,793,828 A 12/1988 Burnand
4,797,241 A 1/1989 Peterson et al.
4,802,539 A 2/1989 Hall et al.
4,807,402 A 2/1989 Rai
4,828,582 A 5/1989 Frushour
4,844,185 A 7/1989 Newton, Jr. et al.
4,861,350 A 8/1989 Phaal et al.
4,871,377 A 10/1989 Frushour
4,899,922 A 2/1990 Slutz et al.
4,919,220 A 4/1990 Fuller et al.
4,940,180 A 7/1990 Martell
4,943,488 A 7/1990 Sung et al.
4,944,772 A 7/1990 Cho
4,976,324 A 12/1990 Tibbitts
5,011,514 A 4/1991 Cho et al.
5,027,912 A 7/1991 Juergens
5,030,276 A 7/1991 Sung et al.
5,092,687 A 3/1992 Hall
5,116,568 A 5/1992 Sung et al.
5,120,327 A 6/1992 Dennis
5,127,923 A 7/1992 Bunting et al.
5,135,061 A * 8/1992 Newton, Jr. ..... 175/428
5,176,720 A 1/1993 Martell et al.
5,186,725 A 2/1993 Martell et al.
5,199,832 A 4/1993 Meskin et al.
5,205,684 A 4/1993 Meskin et al.
5,213,248 A 5/1993 Horton et al.
5,238,074 A 8/1993 Tibbitts et al.
5,264,283 A 11/1993 Waldenstrom et al.
5,337,844 A 8/1994 Tibbitts
5,370,195 A 12/1994 Keshavan et al.
5,379,853 A 1/1995 Lockwood et al.
5,439,492 A 8/1995 Anthony et al.
5,464,068 A 11/1995 Najafi-Sani
5,468,268 A 11/1995 Tank et al.
5,469,927 A * 11/1995 Griffin ..... 175/432
5,496,638 A 3/1996 Waldenstrom et al.
5,505,748 A 4/1996 Tank et al.
5,510,193 A 4/1996 Cerutti et al.
5,523,121 A 6/1996 Anthony et al.
5,524,719 A 6/1996 Dennis
5,560,716 A 10/1996 Tank et al.
5,601,477 A 2/1997 Bunting et al.
5,607,024 A 3/1997 Keith et al.
5,620,382 A 4/1997 Cho et al.
5,624,068 A 4/1997 Waldenstrom et al.
5,645,617 A 7/1997 Frushour
5,667,028 A 9/1997 Truax et al.
5,706,906 A 1/1998 Jurewicz et al.
5,718,948 A 2/1998 Ederyd et al.
5,722,499 A 3/1998 Nguyen et al.
5,769,176 A 6/1998 Sumiya et al.
5,776,615 A 7/1998 Wong et al.
5,803,196 A 9/1998 Fielder
5,833,021 A 11/1998 Mensa-Wilmot et al.
5,890,552 A 4/1999 Scott et al.
5,897,942 A 4/1999 Karner et al.
5,954,147 A 9/1999 Overstreet et al.
5,979,578 A 11/1999 Packer
6,006,846 A 12/1999 Tibbitts et al.
6,009,963 A 1/2000 Chaves et al.
6,050,354 A 4/2000 Pessier et al.
6,063,333 A 5/2000 Dennis
6,123,612 A 9/2000 Goers
6,126,741 A 10/2000 Jones et al.
6,149,695 A 11/2000 Adia et al.
6,234,261 B1 5/2001 Evans et al.
6,248,447 B1 6/2001 Griffin et al.
6,269,894 B1 8/2001 Griffin
6,332,503 B1 12/2001 Pessier et al.
6,344,149 B1 2/2002 Oles
6,361,873 B1 * 3/2002 Yong et al. ..... 428/469
6,397,985 B2 6/2002 Wiebe
6,410,085 B1 6/2002 Griffin et al.
6,435,058 B1 8/2002 Matthias et al.
6,443,248 B2 9/2002 Yong et al.
6,544,308 B2 * 4/2003 Griffin et al. ..... 51/309
6,585,064 B2 7/2003 Griffin et al.
6,592,985 B2 7/2003 Griffin et al.
6,601,662 B2 8/2003 Matthias et al.
6,749,033 B2 6/2004 Griffin et al.
7,350,601 B2 * 4/2008 Belnap et al. ..... 175/434
2003/0021995 A1 1/2003 Griffin
2003/0196385 A1 10/2003 Middlemiss
2003/0235691 A1 12/2003 Griffin
2005/0136667 A1 6/2005 Sung
2005/0139397 A1 6/2005 Achilles et al.
2005/0230156 A1 10/2005 Belnap et al.
2007/0181348 A1 8/2007 Lancaster et al.

FOREIGN PATENT DOCUMENTS

EP 0300699 1/1989
EP 0329954 8/1989
EP 0500253 8/1992
EP 0595630 5/1994
EP 0612868 8/1994
EP 0617207 9/1994
EP 0787820 8/1997
EP 0860515 8/1998
EP 1 190 791 A3 3/2002
EP 1712649 10/2006
GB 1349385 4/1974
GB 2048927 12/1980
GB 2268768 1/1994
GB 2323398 9/1998
JP 59219500 12/1984
JP 6009272 6/1991

| | | |
|---|---|---|
| RU | 2034937 | 5/1995 |
| RU | 566439 | 1/2000 |
| WO | 9323204 | 11/1993 |
| WO | 9634131 | 10/1996 |
| WO | 0028106 | 5/2000 |
| WO | 2004040095 | 5/2004 |
| WO | 2004098875 | 11/2004 |
| WO | 2004106003 | 12/2004 |
| WO | 2004106004 | 12/2004 |

OTHER PUBLICATIONS

UK Examination Report for corresponding British Patent Application No. GB 0601440.1 dated Mar. 25, 2009, 3 pages.

Office Action for parent U.S. Appl. No. 11/043,901, now Pat 7,350,601; dated Mar. 20, 2007; 8 pages.

Office Action for parent U.S. Appl. No. 11/043,901, now Pat 7,350,601; dated Sep. 19, 2007; 6 pages.

UK Search and Examination Report for corresponding British Patent Application No. GB 0601440.1 dated Oct. 6, 2009, 4 pages.

UK Examination Report for corresponding British Patent Application No. GB 0601440.1 dated Oct. 6, 2009, 3 pages.

* cited by examiner

CUTTING ELEMENTS FORMED FROM ULTRA HARD MATERIALS HAVING AN ENHANCED CONSTRUCTION

RELATION TO COPENDING APPLICATION

This patent application is a continuation of and claims priority from U.S. patent application Ser. No. 11/043,901 that was filed on Jan. 25, 2005, and which is hereby incorporated herein in its entirety.

FIELD OF THE INVENTION

This invention generally relates to cutting elements formed from ultra hard materials and, more specifically, to polycrystalline diamond cutting elements having one or more layers that are specially engineered to provide an enhanced degree of cutting and/or thermal performance when compared to conventional polycrystalline diamond cutting elements, thereby providing an improved degree of service life in desired cutting and/or drilling applications.

BACKGROUND OF THE INVENTION

Cutting or wear elements formed from ultra hard materials such as polycrystalline diamond (PCD) used in applications such as with drill bits used for subterranean drilling are well known in the art. Such known cutting elements comprise PCD that is formed by combining synthetic diamond grains with a suitable solvent catalyst material to form a mixture. The mixture is subjected to processing conditions of extremely high pressure/high temperature (HPHT), where the solvent catalyst material promotes desired intercrystalline diamond-to-diamond bonding between the grains, thereby forming a PCD structure. The resulting PCD structure has enhanced properties of wear resistance and hardness, making PCD materials extremely useful in aggressive wear and cutting applications where high levels of wear resistance and hardness are desired.

Such cutting elements typically include a metallic substrate material that is joined to a layer or body of the PCD material during the same HPHT process that is used to form the PCD body. The metallic substrate facilitates attachment of the PCD cutting element to the cutting or drilling device being used, e.g., a drill bit used for subterranean drilling, by conventional attachment method such as welding and the like.

Techniques have been used to improve the wear resistance of the surface of the PCD material, i.e., the surface placed into cutting engagement, for the purpose of extending the service life of the cutting element. PCD is known to suffer thermal degradation at a temperature starting at about 400° C. and extending to 1200° C. and, thus conventional PCD cutting elements are known to have poor thermal stability when exposed to operating temperatures approaching 700° C. Therefore, some of the techniques used for improving the wear resistance of PCD have focused at improving the thermal stability of the PCD. One such approach has involved acid leaching an uppermost layer of an otherwise conventional PCD body to remove substantially all of the solvent metal catalyst material therefrom, while leaving the solvent metal catalyst in the remaining portion of the PCD body.

While this technique is known to improve the thermal stability of the treated uppermost layer, PCD cutters that have been treated in this manner are known to suffer from delamination and spalling during use, leading to premature failure of the cutting element and the drilling device including the same.

It is, therefore, desired that a PCD cutting element be developed that provides improved properties of wear resistance and thermal stability when compared to conventional PCD cutting elements in a manner that reduces or minimizes unwanted delamination and/or spalling, thereby providing improved cutting element service life. It is further desired that such PCD cutting element be constructed using available materials and methods.

SUMMARY OF THE INVENTION

Cutting elements of this invention formed from ultra hard materials generally include an ultra hard body that is joined together with a metallic substrate. In an example embodiment, the ultra hard body is a diamond body that includes an uppermost layer comprising a plurality of bonded diamond crystals and a plurality of interstitial regions disposed among the crystals. The uppermost layer includes an outer surface that is a working surface of the body. In one invention embodiment, the outer region extends from at least a portion of the outer surface to a depth within the uppermost layer, and is substantially free of a catalyst material. In an invention embodiment, the uppermost layer may or may not include a remaining region that includes the catalyst material. In another invention embodiment, the uppermost layer outer region includes the catalyst material as does the remaining region of the uppermost later.

The diamond body further includes an intermediate layer that is joined to the uppermost layer and that comprises a plurality of bonded diamond crystals. The intermediate layer is specifically designed to have a wear resistance that is less than that of the uppermost layer remaining region to provide for the preferential wear of the intermediate layer relative to the uppermost layer, and to eliminate or resist any cracking during use. Such differential wear resistance can be achieved by using differently sized diamond grains to form the uppermost and intermediate layers and/or by using different diamond grain content, and/or by adding different materials to form the intermediate layer.

The diamond body may additionally include lowermost layer that is interposed between and attached to the intermediate layer and the substrate. The lowermost layer is optional and is useful in those constructions where a further polycrystalline diamond layer is needed to provide a strong bond between the diamond body and the metallic substrate. In an example embodiment, the lowermost layer is formed from diamond grains having an average particle size greater than the average particle size of the diamond grains used to form the intermediate layer. In another example embodiment, the lowermost layer has a diamond content that is greater than that of the intermediate layer.

Cutting elements constructed in accordance with the principles of this invention, when formed from PCD, provide improved properties of wear resistance and thermal stability when compared to conventional PCD cutting elements in a manner that reduces or minimizes unwanted delamination and/or spalling, thereby providing improved cutting element service life.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION OF THE INVENTION

Cutting elements, constructed in accordance with the principles of this invention, are specially engineered having improved characteristics designed to enhance cutting and drilling performance of a drill bit when compared to cutting elements formed from conventional ultra hard materials such as PCD. Cutting elements of this invention generally comprise an ultra hard material body having a multi-layer construction including an uppermost layer and an underlying intermediate layer interposed between the uppermost layer and a metallic substrate.

The uppermost layer is formed from an ultra hard material selected from PCD, PcBN, and mixtures thereof, wherein the ultra hard material is made from coarse-grade or coarse-sized grains, and includes an outer surface region. In one invention embodiment, the outer surface region has been treated to render it relatively more thermally stable than a remaining or untreated region of the uppermost layer. In another invention embodiment, the outer surface region is formed from an untreated ultra hard material. The intermediate layer is formed from a material that is relatively less wear resistant than the uppermost layer to both facilitate preferential wear or erosion of the intermediate layer when the cutter is placed into a drilling operation to keep a cutting edge of the uppermost layer sharp, and to provided a related reduced contact area beneath the uppermost layer, which operates to reduce unwanted friction and the transfer of related friction generated thermal energy into the cutting element.

Cutting elements of this invention may include a further ultra hard material layer, interposed between the intermediate layer and the substrate, if needed to provide a desired bond with the metallic substrate and/or to provide an enhanced degree of toughness for eliminating or reducing the severity of any cracking in that layer.

Figure 1:
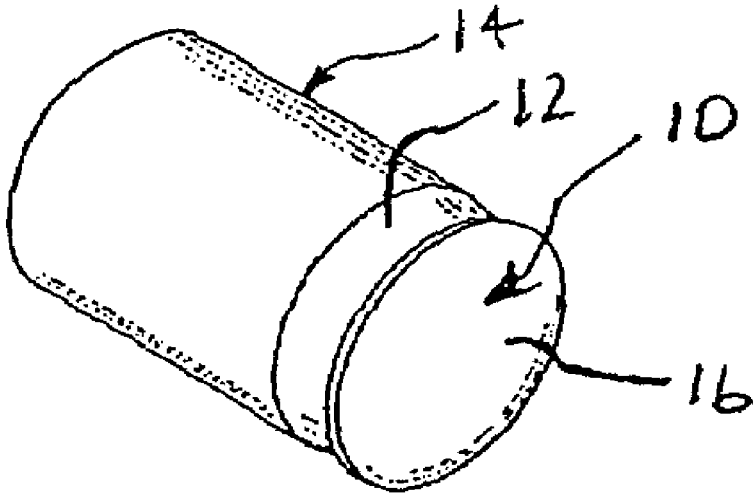
FIG. 1 is a perspective view of a cutting element constructed in accordance with the principles of this invention.

FIG. 1 illustrates an example embodiment cutting element 10 of this invention embodied in the form of a shear cutter used, for example, with a drag bit for drilling subterranean formations. The cutter 10 generally comprises an ultra hard material body 12 that is sintered or otherwise attached to a cutter substrate 14. The cutter includes a working or cutting surface 16 positioned along an outside surface of the ultra hard material body that is engineered to have desired properties of wear resistance and thermal stability.

It is to be understood that the working or cutting surface of the shear cutter can extend from an upper surface of the ultra hard material body to a beveled surface of the body that defines a circumferential edge of the upper surface. Additionally, if desired, the wear resistant and thermally stable region of the body can extend from the beveled or other working surface a distance axially along a side surface of the body to provide an enhanced degree of thermal stability and thermal resistance to the cutter. It is to be understood that cutting elements of this invention can be embodied as shear cutters having geometries other than that specifically described above and illustrated in FIG. 1.

Figure 2:
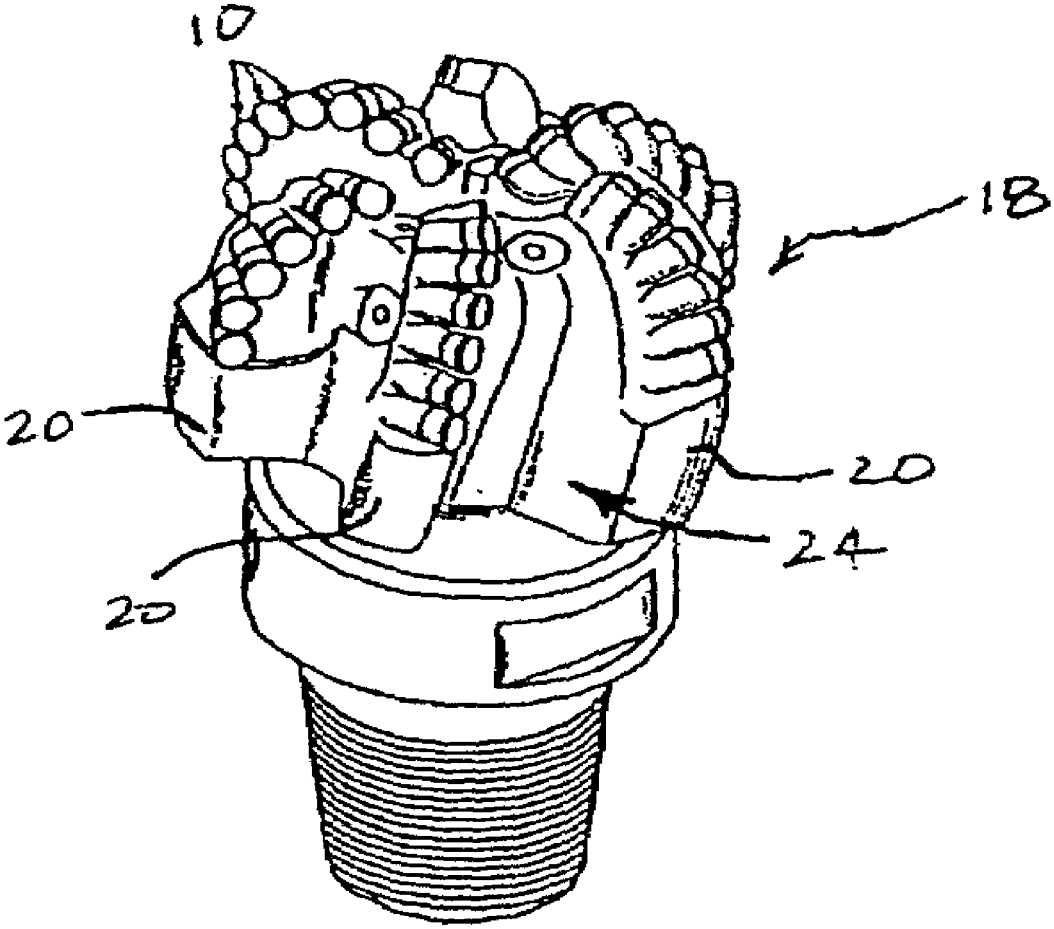
FIG. 2 is a perspective view of a subterranean drill bit comprising a number of the cutting elements of this invention.

FIG. 2 illustrates a drag bit 18 comprising a plurality of the shear cutters 10 described above and illustrated in FIG. 1. The shear cutters are each attached to blades 20 that extend from a head 24 of the drag bit for cutting against the subterranean formation being drilled. Because the cutting elements of this invention include a metallic substrate, they are attached to the blades by conventional method, such as by brazing or welding and the like.

Figure 3:
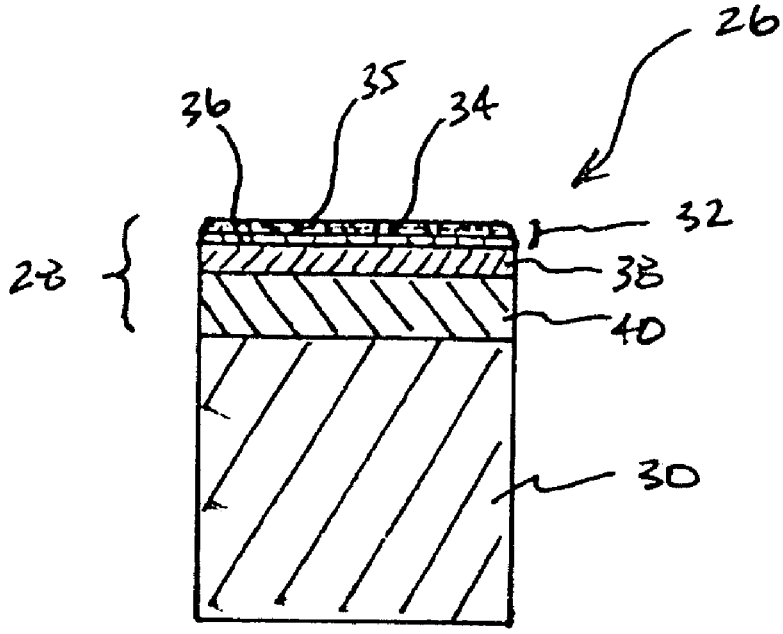
FIG. 3 is a cross-sectional side view of a first embodiment cutting element of this invention.

FIG. 3 illustrates a first embodiment cutting element 26 of this invention comprising, in its most general sense an ultra hard material body 28 that is sintered or otherwise attached to a substrate 30, e.g., a metallic substrate. In a preferred embodiment, the ultra hard material body comprises PCD. The PCD body comprises a number of different layers or regions that are joined to one another and that are each specially engineered to contribute specific properties to the overall construction. In this particular embodiment, the PCD body 28 includes an uppermost layer 32. The uppermost layer is formed from a PCD material that is capable of providing a high degree of wear resistance. In an example embodiment, the uppermost layer 32 comprises PCD that is formed using relatively tough/coarse-grade diamond grains.

In this example embodiment, the uppermost layer 32 includes an outer region 34 that includes an outer surface 35 that defines a working or cutting surface of the cutting element. The outer region 34 is treated to a predetermined depth extending below the outer surface to render it relatively more thermally stable than a remaining region 36 of the uppermost layer 32.

Coarse-sized diamond grains are used to form the uppermost layer for the purpose of inhibiting any unwanted loss of the thermally stable outer region 34 through spalling and delamination along the boundary between the thermally stable outer region 34 and the remaining region 36 of the uppermost layer. In an example embodiment, the uppermost layer 32 is formed by using synthetic or natural diamond grains having an average particle size in the range of from about 10 to 80 micrometers, preferably greater than about 20 micrometers in size, and more preferably within the range of from about 20 to 40 micrometers in size. It is to be understood that the diamond grain sizes noted above are intended to be representative of an average grain size of the diamond grains that are used. Additionally, the diamond grains used to form the uppermost layer may be of a single size, i.e., have a mono-modal size distribution, or may be a mixture of two or more different diamond grains sizes, i.e., have a multi-modal size distribution.

It is to be understood that the exact size of the diamond grains and/or the exact distribution of differently sized diamond grains used to form the uppermost layer 32 will vary depending on the particular use application. Additionally, the diamond grain particle size and particle size distribution may also vary based on the type of treatment that is used to render the uppermost layer outer region 34 thermally stable. For example, if the treatment used is acid leaching, to remove substantially all of the matrix material, e.g., solvent metal catalyst, then the diamond size and/or particular size distribution can be specifically tailored to facilitate leaching to achieve a desired depletion depth.

Because it is desired that the uppermost layer outer region be relatively more thermally stable than the remaining layers or portions of the PCD body 28, it is desired that the diamond grain material used to form the uppermost layer have a controlled amount of matrix material, or material other than diamond, present during the process of sintering and consolidation. An example of such matrix materials include those conventionally used to form PCD, such as the solvent metal catalyst materials included in Group VIII of the Periodic table, with cobalt (Co) being the most common.

Conventional PCD materials, comprising sintered diamond grains and such solvent metal catalyst material, are known to suffer from certain unwanted thermal related events as the operating temperature in the PCD material increases. For example, differential expansion is known to occur at temperatures of about 400° C. between the diamond phase in the PCD and the solvent metal catalyst disposed within interstitial regions between the bonded together diamonds. Such differential thermal expansion can cause ruptures to occur in the diamond-to-diamond bonding, and eventually result in the formation of cracks and chips in the PCD structure, rendering the PCD structure unsuited for further use. As the temperature approaches 700° C., the solvent metal catalyst within the PCD material is known to cause an undesired catalyzed phase transformation in diamond (converting it to carbon monoxide, carbon dioxide, or graphite), thereby limiting practical use of the PCD material to about 750° C.

Accordingly, for the purpose of controlling the occurrence of such undesired thermal effects at or adjacent the working or cutting surface, it is desired that the uppermost layer 32 be formed from diamond grains having no greater than about 5 percent by weight solvent metal catalyst, and preferably having less than about 2 percent by weight solvent metal catalyst. Thus, in an example embodiment, the uppermost layer 32 has a diamond volume fraction greater than about 95 percent.

In an effort to obtain better control over the presence of solvent metal catalyst in the uppermost layer, the use of natural diamond may be desired. Unlike synthetic diamond, natural diamond does not include solvent catalyst metal material in its crystals. Since natural diamond does not include diamond crystals having such solvent catalyst materials trapped within the diamond crystals, the use of natural diamond allows the post-pressing removal of a greater percentage of the solvent catalyst material that is used to facilitate intercrystalline diamond bonding for the purpose of forming a thermally stable outer region 34. Alternatively, the uppermost layer may comprise a blend of synthetic diamond and natural diamond, or segregated layers of natural diamond and synthetic diamond. For example, the uppermost layer can be formed by using natural diamond grains in that region that will later become the outer region 34, and synthetic diamond grains can be used to form the remaining region of the uppermost layer.

The thickness of the PCD body uppermost layer 32 will vary on a number of factors such as the diamond grain particle size and/or distribution, the diamond volume fraction, the matrix material, and the particular PCD cutting element use application. In an example embodiment, where the PCD cutting element is a shear cutter used for subterranean drilling, the uppermost layer may have a thickness of generally less than about two millimeters, and preferably within the range of from about 0.25 to 1 millimeters.

The uppermost layer outer region 34 is treated for the purpose of rendering it relatively more thermally stable than the remaining region 36 of the uppermost layer. The technique used for rending the outer region 34 thermally stable can be any one that operates to minimize or eliminate the unwanted thermal impact that the matrix material, e.g., the solvent metal catalyst, has on the PCD material. This can be done, for example, by removing substantially all of the solvent metal catalyst material from the selected region by suitable process, e.g., by acid leaching, aqua regia bath, electrolytic process, or combinations thereof.

Alternatively, rather than actually removing the solvent metal catalyst from the PCD body, the outer region 34 can be rendered thermally stable by treating the solvent metal catalyst in a manner that reduces or eliminates its potential to adversely impact the intercrystalline bonded diamond at elevated temperatures. For example, the solvent metal catalyst can be combined chemically with another material to cause it to no longer act as a catalyst material, or can be transformed into another material that again causes it to no longer act as a catalyst material. Accordingly, as used herein, the terms "removing substantially all" or "substantially free" as used in reference to the solvent metal catalyst is intended to cover the different techniques in treating the solvent metal catalyst to ensure that it no longer adversely impacts the intercrystalline diamond in the uppermost PCD layer with increasing temperature.

In an example embodiment, the outer region is rendered thermally stable by having substantially all of the catalyst solvent material removed therefrom by an appropriate treatment. The thermally stable outer region extends a predetermined depth beneath the outer surface 35. The thermally stable outer region 34 can extend from the outer surface 35 to a depth of up to about 0.09 mm in one example embodiment, from about 0.02 mm to 0.09 mm in another example embodiment, and from about 0.04 mm to about 0.08 mm in a further example embodiment. It is to be understood that the depth of the outer region 34 will vary depending on factors such as the diamond volume fraction, the diamond particle size, the end use application or the like.

In an example embodiment, substantially all of the catalyst material is removed from the uppermost layer outer region 34 by exposing the desired outer surface 35 or surfaces to acid leaching, as disclosed for example in U.S. Pat. No. 4,224,380, which is incorporated herein by reference. Generally, after the PCD cutting element is made by HPHT process, the identified surface or surfaces to be treated, e.g., the outer surface 35 of the uppermost layer outer region 34, are placed into contact with the acid leaching agent for a sufficient period of time to produce the desired leaching or catalyst material depletion depth. In an example embodiment, this is done after the cutting element has been machine finished to an approximate final dimension. The PCD cutting element is prepared for treatment by protecting the substrate surface and other portions of the PCD body 28 adjacent the desired treated region from contact (liquid or vapor) with the leaching agent. Methods for protecting the remaining surface of the substrate and/or PCD body include covering, coating or encapsulating the substrate and/or PCD body surface with a suitable barrier member or material such as wax, plastic or the like.

Suitable leaching agents for treating the selected region to be rendered thermally stable include materials selected from the group consisting of inorganic acids, organic acids, mixtures and derivatives thereof. The particular leaching agent that is selected can depend on such factors as the type of catalyst material used, and the type of other non-diamond metallic materials that may be present in the uppermost PCD layer. In an example embodiment, suitable leaching agents include hydrofluoric acid (HF), hydrochloric acid (HCl), nitric acid ($HNO_3$), and mixtures thereof. The leaching agent may be heated to achieve a desired leaching performance.

Figure 4:
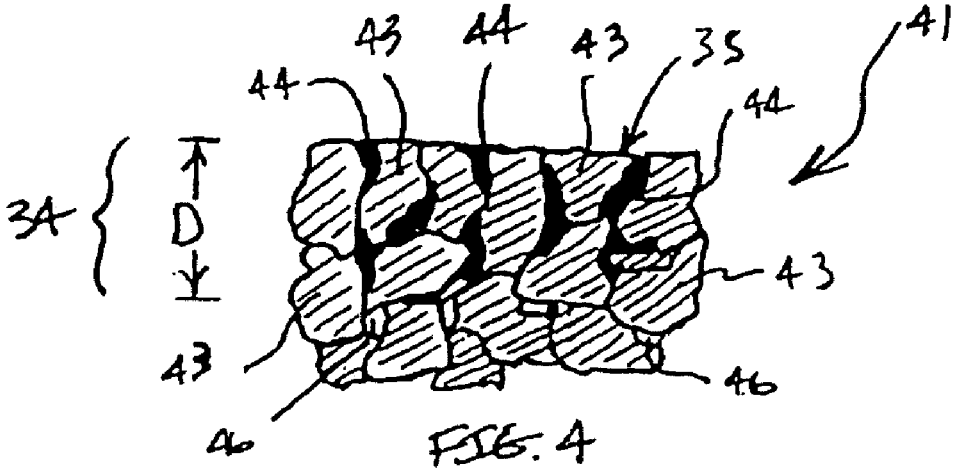
FIG. 4 is a schematic cross-sectional side view of a region of the cutting element of this invention including an uppermost surface.

FIG. 4 illustrates the material microstructure 41 taken from a section of the uppermost layer that includes the thermally stable outer region 34. The thermally stable outer region 34 extends from the outer surface 35 and comprises intercrystalline bonded diamond made up of the plurality of bonded together diamond grains 43, and a matrix of interstitial regions 44 between the diamond grains that are substantially free of the catalyst material. The outer region 34 comprising the interstitial regions free of the catalyst material is shown to extend a distance or depth "D" from the outer surface 35. The remaining region 36 within the uppermost layer that extends below the depth "D" is shown to include the catalyst material 46 within the interstitial regions between the diamond grains.

Although not illustrated in FIG. 3, it may be desired in certain applications to extend the outer region 34 so that it not only projects from the outer surface 35 of the uppermost layer 32 located along the top of the uppermost layer, but so that it projects a depth from an outer surface of the uppermost layer 32 that runs along a side of the uppermost layer. This can be in addition to any portion of the outer region 34 that defines a beveled section extending circumferentially therearound. For example, the uppermost layer 32 can be treated so that the thermally stable region extends along both the outer surface 35 and side surfaces of the uppermost layer. Such side surface thermally stable region can extend to the interface of the intermediate layer if desired. Having a thermally stable region positioned along at least a length of the uppermost layer side surface may be desired for those applications calling for improved properties or wear resistance along this portion of the cutting element.

Additionally, while the thermally stable outer region has been described and illustrated as projecting a depth along the entire outside surface 35, it is to be understood that there may be applications where thermally stability along the entire outside surface is not desired or not necessary. It is, therefore, to be understood that the outer region can be constructed to occupy either the entire region along the uppermost layer outside surface, or a partial region depending on the particular application.

While a particular example embodiment of the invention has been described and illustrated as having an uppermost layer outer region that is treated for rendering it relatively more thermally stable that the remaining region of the uppermost layer, embodiments of this invention can alternatively be constructed comprising an uppermost layer outer region that has not been treated, e.g., when formed from PCD such outer region is not substantially free of the catalyst material. In such alternative embodiment, the uppermost layer may include an outer region and remaining region that are each formed from the same or different ultra hard material, depending on the particular use application. For example, the outer region and remaining region of the uppermost layer each can be formed from PCD of the same type noted above for forming the uppermost layer. Alternatively, when the uppermost layer is formed from PCD or other type of ultra hard material, it can be constructed to comprise the same grain size and volume fraction of ultra hard material throughout, or can be constructed to have different regions each comprising a different grain size and/or volume fraction of the ultra hard material, again depending on the particular end use application and related desired properties of the uppermost layer.

Alternatively, for certain use applications such as those calling for a high degree of wear resistance and/or thermal stability, it is understood that the entire portion of the uppermost can be treated to render it thermally stable, i.e., can be treated so that it is substantially free of the catalyst material.

Referring back to FIG. 3, the PCD body 28 includes an intermediate layer 38 that extends within the body a depth from the uppermost layer 32 towards the substrate 30. The intermediate layer is specially engineered to be less wear resistant than the uppermost layer 32 for the purpose of promoting the development of steady state wear in an area of the PCD body located beneath the uppermost layer to thereby preserve cutting edge sharpness. Additionally, it has been discovered that by engineering the intermediate layer in this manner, i.e., to preferentially wear relative to the uppermost layer, this also operates to reduce frictional heat that is generated by contact between the intermediate layer and the formation being cut, thereby helping to minimize any related unwanted thermal effects in this region of the PCD body.

The intermediate layer can be formed from the same types of ultra hard materials described above for forming the uppermost layer. Such preferential wearing of the intermediate layer relative to the uppermost layer can be achieved in a number of ways. In one embodiment, such preferential wearing can be achieved by forming the intermediate layer from an ultra hard material such as PCD material having a relatively larger amount of matrix material, e.g., solvent metal catalyst or other material, than that present in the uppermost layer to thereby dilute the diamond content within the intermediate layer. Using this approach, the diamond volume fraction in the intermediate layer can be diluted by using an amount of solvent metal catalyst in excess of that noted above for the uppermost layer, i.e., by using greater than about 5 percent by weight solvent metal catalyst. Alternatively, or in addition to using the solvent metal catalyst, other materials can be used as the matrix material to lower the diamond volume fraction in the intermediate layer to reduce its wear resistance. Such other materials useful in this capacity include cubic boron nitride (cBN), cermet materials, ceramic material, and materials that generally include a hard grain phase and a ductile binder phase, wherein the hard grains can be selected from the group W, Ti, Mo, Nb, V, Hf, Ta, and Cr carbides, and the ductile binder phase can be selected from the group consisting of steel, Co, Ni, Fe, W, Mo, Ti, Ta, V, Nb, C, B, Cr, Mn, and alloys thereof.

Such preferential wearing of the intermediate layer relative to the uppermost layer can also be achieved by forming the intermediate layer from an ultra hard material having grains sized differently from that used to form the uppermost later. For example, when the intermediate layer is formed from a PCD material, by using diamond grains that are sized differently from that used to form the uppermost layer. Like the uppermost PCD layer 32, the intermediate layer can be formed from a mono-modal or multi-modal distribution of differently sized ultra hard material grains, e.g., diamond grains. For example, a PCD material formed from fine-sized diamond grains can provide an intermediate layer having a desired reduction in wear resistance relative to the uppermost layer. In an example embodiment, a desired reduction in wear resistance can be achieved by using diamond grains that have an average particle size of less than about 20 micrometers, with 10 percent by weight or more of the matrix material, e.g., having a diamond composition or content of 90 percent by weight or less.

Additionally, forming the intermediate layer from a PCD material using coarse-sized diamond grains can also provide a desired reduction in wear resistance relative to the uppermost layer. In an example embodiment, coarse-sized diamond grains having an average particle size of greater than about 40 micrometers can be used, preferably having an average particle size within the range of from about 40 to 100 micrometers, with or without a matrix material or second phase.

The choice of diamond grain size selected will also impact the ability of the intermediate PCD layer to form a desired bond with an adjacent PCD layer or the substrate during HPHT processing. For example, if diamond grains having a fine particle size are used for forming the intermediate layer, it may be necessary to use a further intervening PCD layer to join the intermediate layer to the substrate. If diamond grains having a relatively coarse particle size are used for forming the intermediate layer, a bond of sufficient strength may be formed between the intermediate layer and the substrate so as to avoid the need to use a further intervening PCD layer.

In the first embodiment PCD cutter element illustrated in FIG. 3, the intermediate layer 38 is formed using diamond grains having an average particle size of between 1 and 20 micrometers, and using greater than about 5 percent by weight matrix material in the form of cobalt.

The thickness of the intermediate layer 38 can and will vary on a number of factors such as the diamond grain particle size and/or distribution, the diamond volume fraction, the type of matrix material that is used, whether or not the PCD body includes a further intervening PCD layer between the intermediate layer and the substrate, and the cutting element use application. In an example first embodiment illustrated in FIG. 3, where the PCD cutting element is a shear cutter used for subterranean drilling, the intermediate layer may have a thickness of generally less than about three millimeters, and preferably within the range of from about 0.25 to 2 millimeters.

Referring still to FIG. 3, the PCD body 28 includes a lowermost layer 40 that extends within the body a depth from the intermediate layer 38 towards the substrate, and that is interposed between the intermediate layer and the substrate 30. The lowermost layer is specially engineered to provide a strong bond between the substrate and the intermediate layer for desired applications. Additionally, the lowermost layer 40 can be engineered to have a high level of toughness for the purpose of eliminating or reducing the severity any cracking in the cutting element caused by loads imposed by drilling, which cracking if not controlled could result in cutter failure.

The lowermost layer 40 can be formed form the same types of ultra hard materials discussed above for forming the uppermost and intermediate layers. In an example embodiment, the lowermost layer 40 is a PCD material that is formed by using diamond grains having an average particle size of 20 micrometers or greater for the purpose of providing a desired interface with the substrate to promote formation of a strong bond therebetween during HPHT processing. The diamond grains may include a matrix material content of about 2 percent by weight or greater. In such example embodiment, the matrix material is a solvent metal catalyst such as cobalt.

The thickness of the lowermost layer 40 can and will vary on a number of factors such as the ultra hard material grain particle size and/or distribution, the ultra hard material volume fraction, the type of matrix material, and the cutting element use application. In the first embodiment illustrated in FIG. 3, where the PCD cutting element is a shear cutter used for subterranean drilling, it is desired that the lowermost layer have a thickness that is sufficient to provide a bond of desired strength with the substrate. In an example embodiment, the lowermost layer has a thickness of at least 0.1 millimeters, and preferably within the range of from about 0.25 to 2 millimeters.

Although present in the construction of the first embodiment ultra hard material cutting element comprising PCD illustrated in FIG. 3, it is to be understood that a lowermost layer 40 is not always a necessary part of the ultra hard body, and its presence will depend on the material make up of the intermediate layer.

Figure 5:
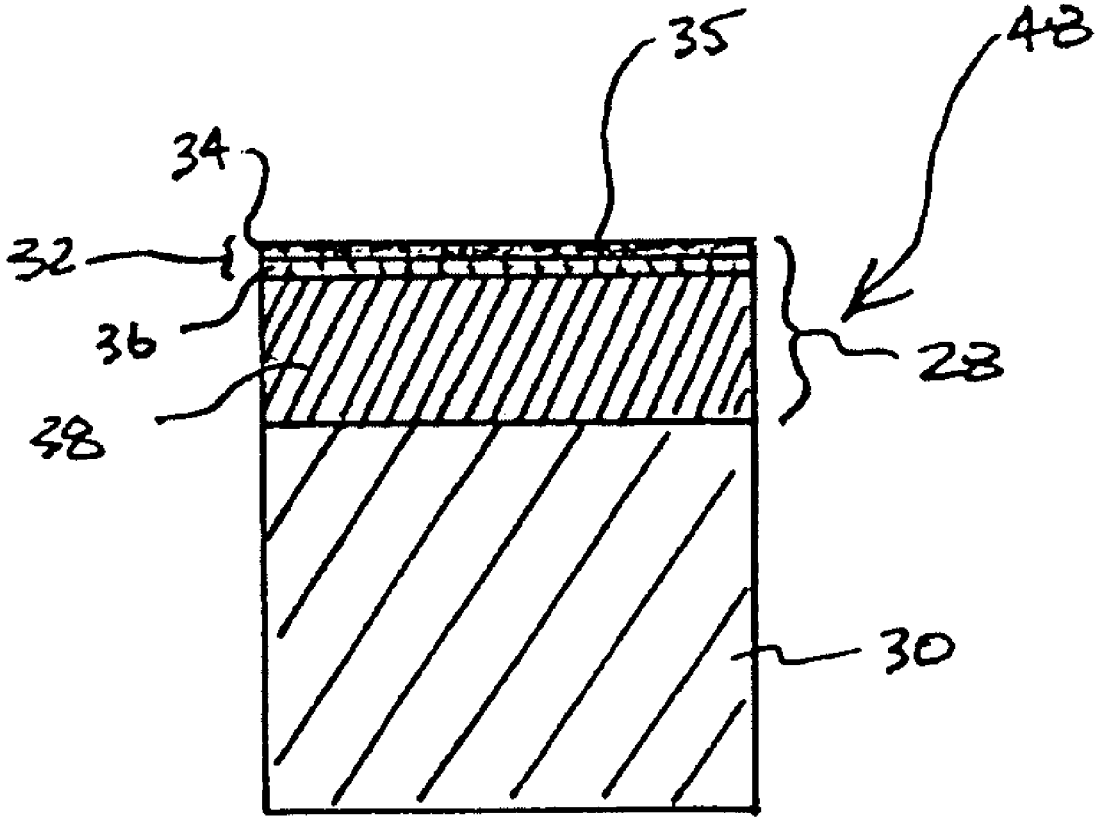
FIG. 5 is a cross-sectional side view of a second embodiment cutting element of this invention.

FIG. 5 illustrates a second embodiment cutter element 48 of this invention that is similar to that of the first embodiment, except that it does not include a lowermost layer. The second embodiment cutting element 48 comprises an ultra hard body 28 made of PCD that is attached to the substrate 30. The PCD body includes an uppermost layer 32 and the intermediate layer 38. The uppermost layer 32 includes a thermally stable outer region 34 that extends a depth beneath the outer surface 35, and a remaining region 36 that extends to the intermediate layer 38. The uppermost layer is formed from the same materials, and the thermally stable outer region is formed in the same manner, as noted above for the first invention embodiment.

In this second embodiment, the use of a lowermost layer is avoided by the selective choice of materials used to form the intermediate layer 38. Specifically, in this particular embodiment, the intermediate layer is a PCD material that is formed from diamond grains having a sufficient particle size to provide a desired bond strength between the intermediate layer and the substrate, thereby permitting joining the PCD construction to the substrate without using a further intervening PCD layer. Additionally, the material selected for forming the intermediate layer is chosen to provide a degree of wear resistance that is less than that of the uppermost layer 32 to provide the desired level of preferential wearing for the same reasons noted above with respect to the first invention embodiment.

In an example second embodiment, the intermediate layer is formed using diamond grains that have an average particle size of 20 micrometers or greater, and that has a matrix material content of 2 percent by weight or greater. The matrix material used in this embodiment can be any one of the material materials noted above useful for forming the intermediate layer of the first invention embodiment, and in a preferred embodiment is cobalt.

The thickness of the intermediate layer 38 used in the second embodiment can and will vary on a number of factors such as the diamond grain particle size and/or distribution, the diamond volume fraction, the type of matrix material, and the cutting element use application. In the second embodiment illustrated in FIG. 5, where the cutting element is a shear cutter used for subterranean drilling, it is desired that the intermediate layer have a thickness that is sufficient to provide a bond of desired strength with the substrate. In an example embodiment, the intermediate layer has a thickness of at least 0.1 millimeters, and preferably within the range of from about 0.25 to 3 millimeters.

Referring to FIGS. 3 and 5, the ultra hard bodies of the first and second embodiment cutter element of this invention are each attached to the substrate 30. Materials useful for forming substrates of this invention include those conventionally used as substrates for conventional PCD and PcBN compacts, such as those formed from metallic and cermet materials. In an example embodiment, the substrate is provided in a preformed state and includes a metal solvent catalyst that is capable of infiltrating into the adjacent diamond powder mixture, used for forming the lowermost layer or the intermediate layer, during HPHT processing to facilitate and provide a bonded attachment therewith. Suitable metal solvent catalyst materials include those selected from Group VIII elements of the Periodic table. A particularly preferred metal solvent catalyst is cobalt (Co). In a preferred embodiment, the substrate is formed from cemented tungsten carbide (WC-Co).

While cutter element embodiments of this invention have been disclosed and illustrated as being generally cylindrical in shape and having a planar disk-shaped outer surface, it is understood that these are but a few example embodiments and that cutter elements of this invention can be configured other than as specifically disclosed or illustrated. It is further to be understood that cutting elements of this invention may be configured having working or cutting surfaces disposed along the disk-shaped outer surface and/or along outer side surfaces of the ultra hard body, depending on the particular cutting or wear application.

Alternatively, the cutting element may be configured having an altogether different shape but generally comprising a substrate and an ultra hard body bonded to the substrate, wherein the ultra hard body is provided with working or cutting surfaces oriented as necessary to perform working or cutting service when the ultra hard cutting element is mounted to a desired drilling or cutting device, e.g., a drill bit.

For example, cutting elements of this invention can be configured having the ultra hard body (comprising the uppermost layer, intermediate layer, and if needed a lowermost layer) disposed onto an interface surface of an underlying substrate that is provided at an angle relative to an axis running through the substrate. ConFIGured in this manner, the cutting element includes a generally disk-shaped outer surface, that is the working or cutting surface of the cutting element, and that is positioned at an angle relative to the axis running through the substrate.

In another example, cutting elements of this invention can be configured with an ultra hard body attached to a substrate, wherein the ultra hard constriction includes a dome-shaped or convex outside surface forming the working or cutting surface of the cutting element.

Further, while cutting elements of this invention have been described and illustrated as comprising an ultra hard body attached to a generally planar interface surface of an underlying substrate, it is to be understood that ultra hard bodies of this invention can be joined with substrates having interface surfaces that are not uniformly planar, e.g., that can be canted or otherwise non-axially symmetric. Thus, cutting elements of this invention can be configured having ultra hard body-substrate interfaces that are uniformly planar or that are not uniformly planar in a manner that is symmetric or nonsymmetric relative to an axis running through the substrate.

Cutting elements of this invention are formed by HPHT processes. Specifically, for PCD cutting elements, the diamond grain powder and matrix material mixture for each PCD body layer is preferably cleaned, arranged, and loaded into a desired container for placement adjacent a desired substrate. The container and substrate is placed within a suitable HPHT consolidation and sintering device, and the device is then activated to subject the container and the substrate to a desired HPHT condition to consolidate and sinter the different diamond powder mixtures, forming the different layers of the PCD body, and joining the PCD body to the substrate.

Alternatively, the different materials used for making the uppermost layer, intermediate layer, and lowermost layer can each be provided in the form of a green-state part, e.g., in the form of a disc or tape casting, made by the process of combining the respective powder materials with a suitable binding agent to enable shaping the resulting mixture into the shape of a part that can be formed, arranged, and loaded into the desired container for subsequent HPHT processing as disclosed above. Wherein, in the event that the layers forming the PCD body are provided in the form of green-state parts, the process of HPHT processing may be prompted by a preheating step to drive off the binding agent prior to consolidation and sintering.

In an example embodiment, the device is controlled so that the container is subjected to a HPHT process comprising a pressure in the range of from 5 to 7 GPa and a temperature in the range of from about 1320 to 1600° C., for a sufficient period of time. During this HPHT process, the matrix material, e.g., solvent metal catalyst material, in each of the respective diamond grain mixtures melts and infiltrates the respective diamond grain powders to facilitate intercrystalline diamond bonding. During the formation of such intercrystalline diamond bonding, the catalyst material migrates into the interstitial regions of the respective different layers within the PCD body that exists between the diamond-bonded grains.

Once the HPHT process is completed, the so-formed PCD cutting element is removed from the device and is prepared for treatment to render the outer region of the uppermost layer thermally stable as disclosed above. In an example embodiment, the PCD cutting element is finished machined to an approximate final dimension prior to treatment so that the depth of the thermally stable outer region remains substantially constant and does not change from treatment to use of the so-formed element.

Cutting elements of this invention, comprising a PCD body made up of the multiple layers described above, provide properties of improved thermal stability while also providing improved service life when compared to conventional thermally stable PCD cutting elements that may include an leached upper region. PCD cutting elements of this invention, having an uppermost layer formed from coarse-sized diamond grains and that includes a thermally stable outer region, provide an improved degree of thermal stability while at the same time resisting spalling an delamination of the thermally stable region. PCD cutting elements of this invention, having an intermediate layer formed from a diamond mixture providing a degree of wear resistance that is less than that of the uppermost layer, operate to maintain the sharpness of the cutting edge while at the same time minimize unwanted frictional heat generation and related heat transfer into the PCD body. Together, these features operate to provide PCD cutting elements having an improved service life when compared to conventional thermally stable PCD cutting elements having a leached upper region.

Other modifications and variations of cutting elements constructed according to the principles of this invention will be apparent to those skilled in the art. It is, therefore, to be understood that within the scope of the appended claims, this invention may be practiced otherwise than as specifically described.

What is claimed is:

1. A cutting element for drilling a subterranean formation comprising:

an ultra hard body comprising:

an uppermost polycrystalline diamond layer comprising an outer region that is substantially free of a catalyst material, and a remaining region that includes the catalyst material; and an intermediate polycrystalline diamond layer joined to the uppermost layer, wherein the intermediate layer is less wear resistant than the uppermost layer, and wherein the intermediate layer has an outer surface that engages the subterranean formation being drilled to preferentially wear relative to the uppermost layer to form a sharpened cutting edge in the ultra hard body; and a metallic substrate attached to the ultra hard body, wherein the intermediate layer is interposed between the uppermost layer and the substrate, and wherein the average size of diamond crystals in the uppermost layer is different from the average size of diamond crystals in the intermediate layer.

2. The cutting element as recited in claim 1 wherein the volume percent of diamond bonded crystals in the uppermost layer is different from diamond bonded crystals in the intermediate layer.

3. The cutting element as recited in claim 1 wherein the uppermost layer comprises less than about 2 percent by weight catalyst material.

4. The cutting element as recited in claim 1 wherein the ultra hard body includes a substantially planar top surface and a substantially cylindrical side surface, and wherein the intermediate layer outer surface extends to form part of the side surface.

5. The cutting element as recited in claim 1 wherein diamond crystals in the uppermost layer have an average particle size greater than about 20 micrometers, and diamond crystals in the intermediate layer have an average particle size greater than about 40 micrometers.

6. The cutting element as recited in claim 5 wherein the diamond crystals in the uppermost layer have an average size of 20 to 40 micrometers, and wherein the diamond crystals in the intermediate layer have an average size of 40 to 100 micrometers.

7. The cutting element as recited in claim 1 wherein the outer region depth from about 0.02 mm to about 0.09 mm.

8. A bit for drilling subterranean formations comprising a body and a number of blades extending therefrom, wherein one or more of the blades include one or more cutting element as recited in claim 1 attached thereto.

9. A shear cutter for drilling a subterranean formation comprising:

an ultra hard body comprising a substantially planar top surface and a cylindrical side surface, the body comprising:

an uppermost polycrystalline diamond layer comprising an outer region that is substantially free of a catalyst material, and a remaining region that includes the catalyst material; and an intermediate polycrystalline diamond layer joined to the uppermost layer, wherein the intermediate layer has a wear resistance less than that of the uppermost layer and forms a portion of the body side surface that contacts the subterranean formation during drilling to preferentially wear away relative to the uppermost layer to form a sharpened edge of the body; and a metallic substrate attached to the ultra hard body, wherein the intermediate layer is interposed between the uppermost layer and the substrate, and wherein the average size of diamond crystals in the uppermost layer is different from the average size of diamond crystals in the intermediate layer.

10. The shear cutter as recited in claim 9 wherein the volume fraction of diamond bonded crystals in the uppermost layer is greater than the volume fraction of diamond bonded crystals in the intermediate layer.

11. The shear cutter as recited in claim 9 wherein the uppermost layer includes diamond crystals having an average size of greater than 20 micrometers, and the intermediate layer include diamond crystals having an average size greater than 40 micrometers.

12. The shear cutter as recited in claim 11 wherein the diamond crystals in the uppermost layer have an average size of 20 to 40 micrometers, and the diamond crystals in the intermediate layer have an average size of 40 to 100 micrometers.

13. The shear cutter as recited in claim 9 wherein the outer region of the uppermost layer extends along the side surface of the ultra hard body.

14. The shear cutter as recited in claim 9 wherein the outer region of the uppermost layer extends along the side surface a length that covers at least a portion of the remaining region.

15. The shear cutter as recited in claim 14 wherein the uppermost layer remaining region comprises less than about 2 percent by weight catalyst material, and the intermediate layer comprises greater than about 5 percent by weight catalyst material.

16. The shear cutter as recited in claim 9 wherein the ultra hard body further comprises a beveled outer surface, and the outer region of the uppermost layer extends therealong.

17. A bit for drilling subterranean formations comprising a body and a number of blades extending therefrom, wherein one or more of the blades comprises the shear cutter as recited in claim 9.

18. A bit for drilling subterranean formations comprising:

a body having a head and having a number of blades extending from the head;

a plurality of cutters disposed in the blades, wherein at least one of the cutters comprises:

an ultra hard body including:

an uppermost polycrystalline diamond layer comprising:

an outer region extending a partial depth from the body outer surface into the uppermost layer, wherein the outer region is substantially free of a catalyst material; and a remaining region that includes the catalyst material;

an intermediate polycrystalline diamond layer joined to the uppermost layer and having a wear resistance that is less than the uppermost layer, the intermediate layer having an outer surface that contacts the subterranean formation to preferentially wear away relative to the uppermost layer to form a sharpened edge along the uppermost layer, wherein diamond crystals in the intermediate layer have an average size different from diamond crystals in the uppermost layer; and a metallic substrate attached to the intermediate layer.

19. The drill bit as recited in claim 18 wherein the body outer surface comprises a substantially planar top surface and a substantially cylindrical side surface that extends axially away from the top surface.

20. The drill bit as recited in claim 19 wherein the outer region is positioned along the top surface of the body.

21. The drill bit as recited in claim 18 wherein the outer region is positioned along the side surface of the body.

22. The drill bit as recited in claim 21 wherein the outer region extends along a length of the body side surface that covers at least a portion of the remaining region.

23. The drill bit as recited in claim 18 wherein the intermediate layer outer surface extends along the body side surface.

24. The drill bit as recited in claim 18 wherein the volume fraction of diamond crystals in the uppermost layer is greater than the volume fraction of diamond crystals in the intermediate layer.

25. The drill bit as recited in claim 18 wherein the diamond crystals in the intermediate layer have an average size greater than about 20 micrometers, and the diamond crystals in the uppermost layer have an average size greater than about 40 micrometers.

26. The drill bit as recited in clam 25 wherein the diamond crystals in the uppermost layer have an average size of 20 to 40 microns, and the diamond crystals in the intermediate layer have an average size of 40 to 100 microns.

27. A shear cutter for drilling a subterranean formation comprising:

an ultra hard body comprising a substantially planar top surface and a cylindrical side surface, the body comprising:

an uppermost polycrystalline diamond layer comprising an outer region that is substantially free of a catalyst material, and a remaining region that includes the catalyst material; and an intermediate polycrystalline diamond layer joined to the uppermost region, wherein the intermediate layer has a wear resistance less than that of the uppermost layer and forms a portion of the body side surface that contacts the subterranean formation during drilling to preferentially wear away relative to the uppermost layer to form a sharpened edge of the body; and a metallic substrate attached to the ultra hard body, wherein the intermediate layer is interposed between the uppermost layer and the substrate, wherein the outer region of the uppermost layer extends along the side surface a length that covers at least a portion of the remaining region, and wherein the uppermost layer remaining region comprises less than about 2 percent by weight catalyst material, and the intermediate layer comprises greater than about 5 percent by weight catalyst material.

* * * * *